US008057973B2

(12) United States Patent
Wu et al.

(10) Patent No.: US 8,057,973 B2
(45) Date of Patent: Nov. 15, 2011

(54) NANO DIAMOND ANTICURL BACKSIDE COATING (ACBC) PHOTOCONDUCTORS

(75) Inventors: Jin Wu, Webster, NY (US); Edward F Grabowski, Webster, NY (US); Lin Ma, Webster, NY (US); Lanhui Zhang, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 445 days.

(21) Appl. No.: 12/360,335

(22) Filed: Jan. 27, 2009

(65) Prior Publication Data

US 2010/0190099 A1 Jul. 29, 2010

(51) Int. Cl.
*G03G 5/00* (2006.01)

(52) U.S. Cl. ..... 430/58.8; 430/58.75; 430/59.1; 430/59.4; 430/56; 430/930

(58) Field of Classification Search ..... 430/58.05, 430/58.75, 58.8, 59.1, 59.4, 66, 69, 56, 930
See application file for complete search history.

(56) References Cited

U.S. PATENT DOCUMENTS

| | | | | |
|---|---|---|---|---|
| 4,654,284 | A | 3/1987 | Yu et al. | |
| 5,021,309 | A | 6/1991 | Yu | |
| 5,069,993 | A * | 12/1991 | Robinette et al. | 430/58.8 |
| 5,096,795 | A | 3/1992 | Yu | |
| 5,919,590 | A | 7/1999 | Yu et al. | |
| 5,935,748 | A | 8/1999 | Yu et al. | |
| 6,010,810 | A * | 1/2000 | Uesaka et al. | 430/58.8 |
| 6,303,254 | B1 | 10/2001 | Yu et al. | |
| 6,528,226 | B1 | 3/2003 | Yu et al. | |
| 6,673,499 | B2 * | 1/2004 | Lee et al. | 430/57.1 |
| 6,939,652 | B2 | 9/2005 | Yu | |
| 2004/0126685 | A1 * | 7/2004 | Horgan et al. | 430/58.3 |
| 2007/0059619 | A1 * | 3/2007 | Shimoyama et al. | 430/58.7 |
| 2008/0241720 | A1 | 10/2008 | Wu et al. | |
| 2010/0190007 | A1 | 7/2010 | Wu | |

OTHER PUBLICATIONS

Jin Wu et al., U.S. Appl. No. 12/033,247 on Anticurl Backside Coating (ACBC) Photoconductors, filed Feb. 19, 2008.
Jin Wu et al., U.S. Appl. No. 12/033,279 on Backing Layer Containing Photoconductor, filed Feb. 19, 2008.

* cited by examiner

*Primary Examiner* — Christopher Rodee
*Assistant Examiner* — Stewart Fraser
(74) *Attorney, Agent, or Firm* — Oliff & Berridge, PLC

(57) ABSTRACT

A photoconductor that includes a first layer, a supporting substrate thereover, a photogenerating layer, and at least one charge transport layer of at least one charge transport component, and wherein the first layer is in contact with the supporting substrate on the reverse side thereof, and which first layer is comprised of a nano diamond component.

27 Claims, No Drawings

NANO DIAMOND ANTICURL BACKSIDE COATING (ACBC) PHOTOCONDUCTORS

CROSS REFERENCE TO RELATED APPLICATIONS

Copending U.S. application Ser. No. 12/360,324, U.S. Publication No. 20100190007 on Nano Diamond Containing Intermediate Transfer Members, filed Jan. 27, 2009, the disclosure of which is totally incorporated herein by reference, illustrates an intermediate transfer member comprised of a nano diamond.

There is disclosed in U.S. application Ser. No. 11/729,622, Publication No. 2008024172, now U.S. Pat. No. 7,662,525, filed Mar. 29, 2007, entitled Anticurl Backside Coating (ACBC) Photoconductors, a photoconductor comprising a first layer, a supporting substrate thereover, a photogenerating layer, and at least one charge transport layer comprised of at least one charge transport component, and wherein the first layer is in contact with the supporting substrate on the reverse side thereof, and which first layer is comprised of a polymer and needle shaped particles with an aspect ratio of from 2 to about 200.

U.S. application Ser. No. 12/033,247, now U.S. Pat. No. 7,771,908, filed Feb. 19, 2008, entitled Anticurl Backside Coating (ACBC) Photoconductors, the disclosure of which is totally incorporated herein by reference, discloses a photoconductor comprising a first layer, a supporting substrate thereover, a photogenerating layer, and at least one charge transport layer comprised of at least one charge transport component, and wherein the first layer is in contact with the supporting substrate on the reverse side thereof, and which first layer is comprised of a fluorinated poly(oxetane) polymer.

U.S. application Ser. No. 12/033,279, now U.S. Pat. No. 7,781,133, filed Feb. 19, 2008, entitled Backing Layer Containing Photoconductor, the disclosure of which is totally incorporated herein by reference, illustrates a photoconductor comprising a substrate, an imaging layer thereon, and a backing layer located on a side of the substrate opposite the imaging layer wherein the outermost layer of the backing layer adjacent to the substrate is comprised of a self crosslinked acrylic resin and a crosslinkable siloxane component.

BACKGROUND

This disclosure is generally directed to photoreceptors, photoconductors, and the like. More specifically, the present disclosure is directed to multilayered drum, or flexible belt imaging members, or devices comprised of a first layer, a supporting medium like a substrate, a photogenerating layer, and a charge transport layer, including a plurality of charge transport layers, such as a first charge transport layer and a second charge transport layer, an optional adhesive layer, an optional hole blocking or undercoat layer, and an optional overcoat layer, and wherein the supporting substrate is situated between the first layer and the photogenerating layer. More specifically, the photoconductors disclosed, which in embodiments permit acceptable anticurl characteristics in combination with excellent conductivity, prolonged wear, surface slipperiness, and scratch resistant characteristics, contain a first backside coating layer or curl deterring backside coating layer (ACBC), and which layer is in contact with and contiguous to the reverse side of the supporting substrate, that is this side of the substrate that is not in contact with the photogenerating layer, and which first layer, ACBC layer of the present disclosure, is comprised of nano diamond and nano diamond components, such as in the form of nano diamond powders.

The ACBC layer of the present disclosure comprises a diamond component and a slippery surface, thus the wear resistance of this layer is excellent, especially as compared to an ACBC layer without any nano diamond, or an ACBC layer containing a polytetrafluoroethylene (PTFE). Also, the coating dispersion containing the nano diamond component is stable for extended time periods; minimal agglomeration of the ACBC layer components is provided, thereby increasing the coating uniformity of this layer; and other advantages as illustrated herein for photoconductors with ACBC layers comprising a nano diamond component.

While not being desired to be limited by theory, it has been postulated that the dispersed nano diamond powder provides a matrix of conductive nanoparticles that contact each other to thereby generate reasonable levels of electrical conductivity, while not filling all the void matrix spaces, thus permitting the transmission of light. The aforementioned partial transparency of about 30 percent allows for excellent photoreceptor applications since the erase illumination is applied from inside the belt module and passes through the ACBC into the photogenerating layer. The electrical conductivity allows the triboelectrically generated charges to move through the layer and discharge before the quantity of charge builds up to significant levels. The nano diamond provides additional mechanical reinforcement which reduces wear, thus minimizing dust buildup.

In some instances, when a flexible layered photoconductor belt is mounted over a belt support module comprising various supporting rollers and backer bars present in a xerographic imaging apparatus, the anticurl or reduction in curl backside coating (ACBC), functioning under a normal xerographic machine operation condition, is repeatedly subjected to mechanical sliding contact against the apparatus backer bars and the belt support module rollers to thereby adversely impact the ACBC wear characteristics. Moreover, with a number of known prior art ACBC photoconductor layers formulated to contain non-needle like additives, the mechanical interactions against the belt support module components can decrease the lifetime of the photoconductor primarily because of wear and degradation after short time periods.

In embodiments, the photoconductors disclosed include an ACBC (anticurl backside coating) layer on the reverse side of the supporting substrate of a belt photoreceptor. The ACBC layer, which can be solution coated, for example, as a self-adhesive layer on the reverse side of the substrate of the photoconductor, comprises known nano diamond components, such as commercially available nano diamond powders that, for example, substantially reduce surface contact friction, and prevent or minimize wear/scratch problems for the photoreceptor device. In embodiments, the mechanically robust ACBC layer of the present disclosure usually will not substantially reduce the layer's thickness over extended time periods adversely affecting its anticurl ability for maintaining effective imaging member belt flatness while minimizing the formation of dirt and debris.

Moreover, high surface contact friction of the backside coating against machines, such as printers, and its subsystems can cause the development of undesirable electrostatic charge buildup. In a number of instances, with devices, such as printers, the electrostatic charge builds up because of high contact friction between the anticurl backside coating and the backer bars which increases the frictional force to the point that it requires higher torque from the driving motor to pull the belt for effective cycling motion. In a full color electrophotographic apparatus using a 10-pitch photoreceptor belt, this electrostatic charge buildup can be high due to the large number of backer bars used in the machine.

The backside coating layers illustrated herein, in embodiments, have excellent wear resistance, extended lifetimes, minimal charge buildup, excellent bulk conductivity, and permit the elimination or minimization of photoconductive imaging member belt ACBC scratches.

Also included within the scope of the present disclosure are methods of imaging and printing with the photoresponsive or photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the toner image to a suitable image receiving substrate, and permanently affixing the image thereto. In those environments wherein the device is to be used in a printing mode, the imaging method involves the same operation with the exception that exposure can be accomplished with a laser device or image bar. More specifically, the flexible photoconductor belts disclosed herein can be selected for the Xerox Corporation iGEN® machines that generate with some versions over 100 copies per minute. Processes of imaging, especially xerographic imaging and printing, including digital and/or color printing, are thus encompassed by the present disclosure. The imaging members are, in embodiments, sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed color copying and printing processes.

REFERENCES

Anticurl backside coating formulations are disclosed in U.S. Pat. Nos. 5,069,993; 5,021,309; 5,919,590; and 4,654,284. However, there is a need to create an anticurl backside coating formulation that has intrinsic properties that minimize or eliminate charge accumulation in photoconductors without sacrificing other electrical properties and allowing low surface energy characteristics. One known ACBC design can be designated as an insulating polymer coating containing additives, such as silica, PTFE or TEFLON®, to reduce friction against backer plates and rollers, but these additives tend to charge up triboelectrically due to their rubbing against the plates resulting in an electrostatic drag force that adversely affects the process speed of the photoconductor.

Photoconductors containing ACBC layers are illustrated in U.S. Pat. Nos. 5,096,795; 5,935,748; 6,303,254; 6,528,226; and 6,939,652.

Belt modules that incorporate large numbers of sliding positioning supports like production xerographic printing machines generate a large amount of electric charge from the sliding contact that is discharged by the use of a somewhat costly combination of a carbon fiber brush and a bias power supply. Failure to discharge the ACBC produces an electrostatic attractive force between the photoreceptor and the support element which increases the normal force producing more drag which complicates photoreceptor belt removal and can become large enough to stall or render inoperative the drive motor. In addition, the multiple points of sliding contact generate a significant quantity of fine polymer dust which coats the machine components and acts as a lubricant, reducing drive roller capacity.

Layered photoresponsive imaging members have been described in numerous U.S. patents, such as U.S. Pat. No. 4,265,990, wherein there is illustrated an imaging member comprised of a photogenerating layer, and an aryl amine hole transport layer.

In U.S. Pat. No. 4,587,189, there is illustrated a layered imaging member with, for example, a perylene, pigment photogenerating component and an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members or photoconductors of the present disclosure in embodiments thereof.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises as a first step hydrolyzing a gallium phthalocyanine precursor pigment by dissolving the hydroxygallium phthalocyanine in a strong acid, and then reprecipitating the resulting dissolved pigment in basic aqueous media. Also, processes for the preparation of photogenerating pigments of hydroxygallium phthalocyanine are illustrated in U.S. Pat. No. 5,473,064, the disclosure of which is totally incorporated herein by reference.

The appropriate components, such as the supporting substrates, the photogenerating layer components, the charge transport layer components, the overcoating layer components, and the like, of the above-recited patents may be selected for the photoconductors of the present disclosure in embodiments thereof.

SUMMARY

Disclosed are imaging members containing a mechanically robust ACBC layer that possesses many of the advantages illustrated herein, such as extended lifetimes of the ACBC photoconductor such as, for example, in excess, it is believed, of about 2,500,000 simulated xerographic imaging cycles, and which photoconductors are believed to exhibit ACBC wear and scratch resistance characteristics.

Also disclosed are photoconductors containing a slippery and conductive ACBC layer that minimizes charge accumulations.

Additionally disclosed are flexible belt imaging members comprising the disclosed ACBC, and an optional hole blocking layer or layers comprised of, for example, aminosilanes, metal oxides, phenolic resins, and optional phenolic compounds, and which phenolic compounds contain at least two, and more specifically, two to ten phenol groups or phenolic resins with, for example, a weight average molecular weight ranging from about 500 to about 3,000, permitting, for example, a hole blocking layer with excellent efficient electron transport which usually results in a desirable photoconductor low residual potential $V_{low}$.

EMBODIMENTS

Aspects of the present disclosure relate to a photoconductor comprising a first layer, a flexible supporting substrate thereover, a photogenerating layer, and at least one charge transport layer comprised of at least one charge transport component, and wherein the first layer, which is an anticurl backside coating (ACBC) that minimizes curl, is in contact with the supporting substrate on the reverse side thereof, and which first layer is comprised of a nano diamond component, a supporting substrate thereover, a photogenerating layer, and at least one charge transport layer comprised of at least one charge transport component; a flexible photoconductive imaging member comprised in sequence of an ACBC layer adhered to the reverse side of the supporting substrate, a supporting substrate, a photogenerating layer thereover, a charge transport layer, and a protective top overcoat layer; and a photoconductor which includes a hole blocking layer and an adhesive layer where the adhesive layer is situated between the hole blocking layer and the photogenerating layer, and the hole blocking layer is situated between the substrate and the adhesive layer.

In embodiments, there is disclosed a photoconductor comprising a first layer, a supporting substrate thereover, a photogenerating layer, and at least one charge transport layer comprised of at least one charge transport component, and wherein the first layer is in contact with the supporting substrate on the reverse side thereof, and which first layer is comprised of a nano diamond powder component; a photoconductor comprised in sequence of a supporting substrate, a photogenerating layer thereover, and a charge transport layer, and wherein the substrate includes on the reverse side thereof a nano diamond layer; and a photoconductor comprised in sequence of a supporting substrate, a photogenerating layer thereover, and a hole transport layer, and wherein the substrate includes on the reverse side an ACBC layer comprised of a known nano diamond powder dispersed in a suitable material such as for example disclosed herein, and more specifically, where the photogenerating layer is in contact with the surface of the supporting substrate, and the ACBC layer is in contact with the supporting substrate opposite the surface.

The anticurl backside coating layer possesses a thickness of, for example, from about 1 to about 100, from about 5 to about 50, from about 5 to about 10, or from about 10 to about 30 microns.

Nano Diamond Component Examples

Nano diamonds which are available from, for example, NANOBLOX Inc. comprise in embodiments a core-shell structure with a hard and inert diamond core and a conductive graphite shell where the graphite shell surface includes a spectrum of functional chemical groups like carbon about 76 percent, oxygen about 6 percent and nitrogen about 10 percent directly linking to the graphite carbon, thereby rendering the nano diamond conductive. More specifically, nano diamond can be prepared by the detonation of a diamond blend of synthetic and/or natural diamond, and subsequently by chemical purification with the diameter of the resulting diamond crystals being, for example, from about 1 to about 10 nanometers, and specifically, with an average diameter of about 5 nanometers; a B.E.T. surface area that is no less than about 270 to about 380 square meters per gram with an average grain size of from about 20 to about 50 nanometers; and with a unique rounded shape that provides excellent lubricity characteristics with the hardness and wear resistance of diamond.

Nano diamonds are commercially available from NANOBLOX Inc. in either a powder or a dispersion form. For example, commercially available nano diamond black (NB50) possesses 50 percent of $sp^3$ carbon and 50 percent of $sp^2$ carbon ($sp^3$ diamond core and $sp^2$ graphite envelop, B.E.T. surface area about 460 $m^2$/gram); nano diamond (NB90) possesses 90 percent of $sp^3$ carbon and 10 percent of $sp^2$ carbon ($sp^3$ diamond core and $sp^2$ graphite envelop, B.E.T. surface area about 460 m2/gram); and nano diamond (NB98) possesses 98 percent of $sp^3$ carbon and 2 percent of $sp^2$ carbon ($sp^3$ diamond core and $sp^2$ graphite envelop). Surface modified nano diamonds are also available from NANOBLOX Inc. including modifying the surface with —OH, —COOH, —$NH_2$, or a quaternerized amine, and —$CH_3$, and the corresponding nano diamonds are NB90-OH, NB90-COOH, NB90-$NH_2$ or NB90-quaternerized amine, and NB90-$CH_3$. Metal modified nano diamonds are also available from NANOBLOX Inc. including where the metal is, for example, Cu, Fe, Ag, Au, and Al, and the corresponding nano diamonds like NB90-Cu, NB90-Fe, NB90-Ag, NB90-Au, and NB90-Al. These nano diamonds are readily dispersed in either aqueous or solvent dispersions.

In contrast, a carbon black surface is composed of graphitic planes with very few oxygens and hydrogens at the edges while the nano diamond surface is composed of graphitic planes with a spectrum of functional chemical groups (C is about 76 percent, O is about 6 percent, and N is about 10 percent) with directly linked carbon structures, thus nano diamond is more readily dispersed than carbon black. In addition, the nano diamond should also, it is believed, impart improved mechanical properties to the ACBC layer due to its hard diamond core.

The core shell nano diamond comprises in embodiments a diamond core, present in an amount of from about 40 to about 99.9 weight percent, or from about 50 to about 98 weight percent, or from about 70 to about 95 weight percent. The core shell nano diamond further comprises a conductive shell comprised of graphite (carbon black) and modified graphite (carbon black), such as graphite modified with —OH, —COOH, —$NH_2$, or quaternerized amine, —$CH_3$, Cu, Fe, Ag, Au, and Al, present in an amount of from about 0.1 to about 60 weight percent, from about 2 to about 50 weight percent, or from about 5 to about 30 weight percent.

The nano diamond is present in the ACBC layer in an amount of, for example, from about 0.1 to about 30 weight percent, from about 1 to about 20 weight percent, or from about 5 to about 15 weight percent of the ACBC layer components.

Examples of additional components present in the ACBC layer are a number of known polymers and conductive components.

The anticurl backside coating (ACBC) layer further comprises at least one polymer, which usually is the same polymer that is selected for the charge transport layer or layers. Examples of polymers present, for example, in an amount of from about 70 to about 99.9 weight percent, from about 80 to about 99 weight percent, or from 85 to about 95 weight percent of the ACBC layer, include polycarbonates, polyarylates, acrylate polymers, vinyl polymers, cellulose polymers, polyesters, copolyesters, polysiloxanes, polyamides, polyurethanes, poly(cyclo olefins), epoxies, and copolymers thereof; and more specifically, polycarbonates such as poly (4,4'-isopropylidene-diphenylene)carbonate (also referred to as bisphenol-A-polycarbonate), poly(4,4'-cyclohexylidine diphenylene)carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, the polymeric binder is comprised of a polycarbonate resin with a weight average molecular weight of, for example, from about 20,000 to about 100,000, and more specifically, with a molecular weight $M_w$ of from about 50,000 to about 100,000.

Photoconductive Layer Components

There can be selected for the photoconductors disclosed herein a number of known layers, such as substrates, photogenerating layers, charge transport layers, hole blocking layers, adhesive layers, protective overcoat layers, and the like. Examples, thicknesses, specific components of many of these layers include the following.

A number of known supporting substrates can be selected for the photoconductors illustrated herein, such as those substrates that will permit the layers thereover to be effective. The thickness of the photoconductor substrate layer depends on many factors, including economical considerations, electrical characteristics, adequate flexibility, and the like, thus this layer may be of substantial thickness, for example over 3,000 microns, such as from about 1,000 to about 2,000 microns, from about 500 to about 1,000 microns, or from about 300 to about 700 microns, ("about" throughout includes all values in between the values recited) or of a minimum thickness. In embodiments, the thickness of this layer is from about 75 microns to about 300 microns, or from about 100 to about 150 microns.

The photoconductor substrate may be opaque or substantially transparent, and may comprise any suitable material having the required mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, this layer may be of a substantial thickness of, for example, up to many centimeters, or of a minimum thickness of less than a millimeter. Similarly, a flexible belt may be of a substantial thickness of, for example, about 250 microns, or of a minimum thickness of less than about 50 microns, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, supporting substrate layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations such as, for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer such as, for example, polycarbonate materials commercially available as MAKROLON®.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo) perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 to about 10 microns, and more specifically, from about 0.25 to about 2 microns when, for example, the photogenerating compositions are present in an amount of from about 30 to about 75 percent by volume. The maximum thickness of this layer in embodiments is dependent primarily upon factors, such as photosensitivity, electrical properties, and mechanical considerations.

The photogenerating composition or pigment is present in the resinous binder composition in various amounts. Generally, however, from about 5 percent by volume to about 95 percent by volume of the photogenerating pigment is dispersed in about 95 percent by volume to about 5 percent by volume of the resinous binder, or from about 20 percent by volume to about 30 percent by volume of the photogenerating pigment is dispersed in about 70 percent by volume to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium, and alloys of selenium and arsenic, tellurium, germanium, and the like, hydrogenated amorphous silicon, and compounds of silicon and germanium, carbon, oxygen, nitrogen, and the like fabricated by vacuum evaporation or deposition. The photogenerating layers may also comprise inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder, and fabricated by solvent coating techniques.

In embodiments, examples of polymeric binder materials that can be selected as the matrix for the photogenerating layer are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene-butadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent coated layer may be effected by any known conventional techniques such as oven drying, infrared radiation drying, air drying, and the like.

The coating of the photogenerating layer in embodiments of the present disclosure can be accomplished with spray, dip or wire-bar methods such that the final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer or interfacial layer, and the photogenerating layer. Usually, the photogenerating layer is applied onto the blocking layer, and a charge transport layer or plurality of charge transport layers are formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary, and in embodiments is, for example, from about 0.05 (500 Angstroms) to about 0.3 micron (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As an adhesive layer usually in contact with or situated between the hole blocking layer and the photogenerating layer, there can be selected various known substances inclusive of copolyesters, polyamides, poly(vinyl butyral), poly(vinyl alcohol), polyurethane, and polyacrylonitrile. This layer is, for example, of a thickness of from about 0.001 to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure, further desirable electrical and optical properties.

The optional hole blocking or undercoat layer for the imaging members of the present disclosure can contain a number of components including known hole blocking components, such as amino silanes, doped metal oxides, a metal oxide like titanium, chromium, zinc, tin, and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion are added a phenolic compound and dopant, followed by mixing. The hole blocking layer coating dispersion can be applied by dip coating or web coating, and the layer can be thermally cured after coating. The hole blocking layer resulting is, for example, of a thickness of from about 0.01 to about 30 microns, and more specifically, from about 0.1 to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol, and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The optional hole blocking layer may be applied to the substrate. Any suitable and conventional blocking layer capable of forming an electronic barrier to holes between the adjacent photoconductive layer (or electrophotographic imaging layer), and the underlying conductive surface of substrate may be selected.

A number of charge transport compounds can be included in the charge transport layer, which layer generally is of a thickness of from about 5 to about 75 microns, and more specifically, of a thickness of from about 10 to about 40 microns. Examples of charge transport components are aryl amines as represented by

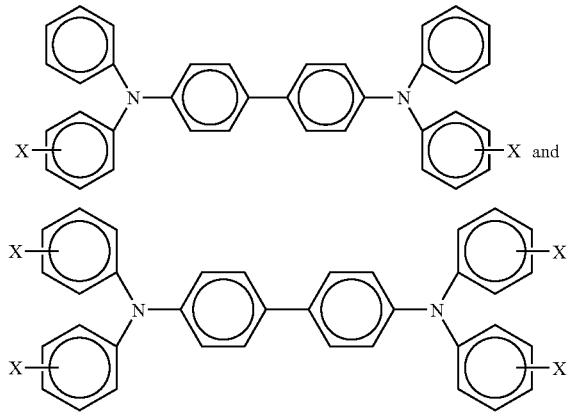

wherein X is a suitable hydrocarbon like alkyl, alkoxy, aryl, and derivatives thereof; a halogen, or mixtures thereof, and especially those substituents selected from the group consisting of Cl and $CH_3$; and components as represented by

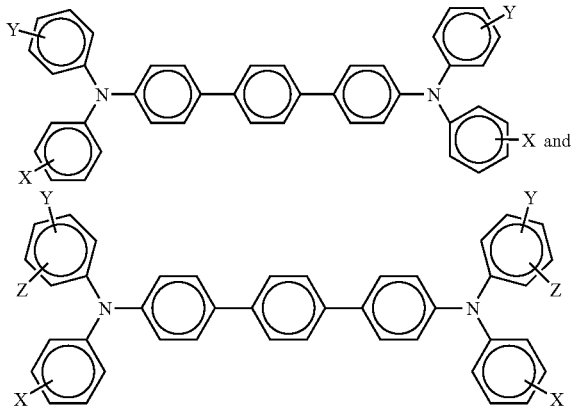

wherein X, Y and Z are independently alkyl, alkoxy, aryl, a halogen, or mixtures thereof; and wherein at least one of Y and Z are present. Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific charge transport components include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylpehenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine N,N'-diphenyl-N,N'-bis(3-chlorophenyl)-[p-terphenyl]-4,4'-diamine, and the like. Other known charge transport layer molecules can be selected, reference for example, U.S. Pat. Nos. 4,921,773 and 4,464,450, the disclosures of which are totally incorporated herein by reference.

In embodiments, the charge transport component can be represented by

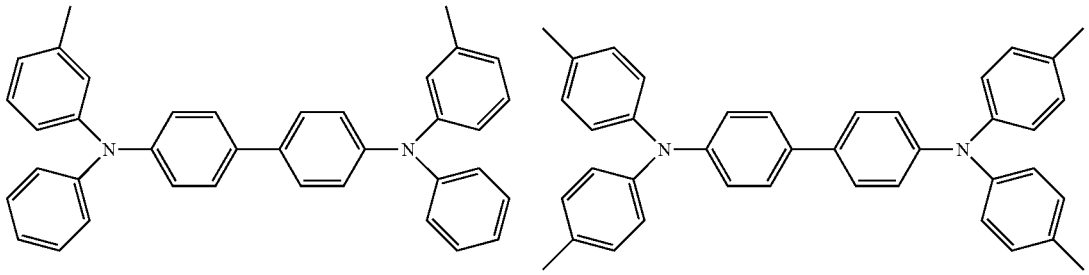

-continued

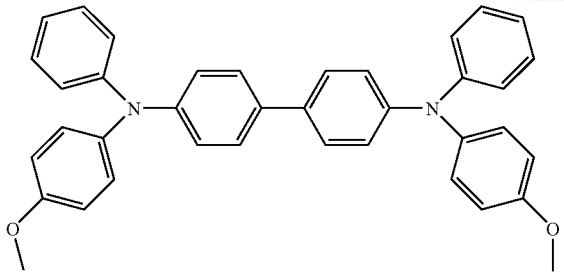

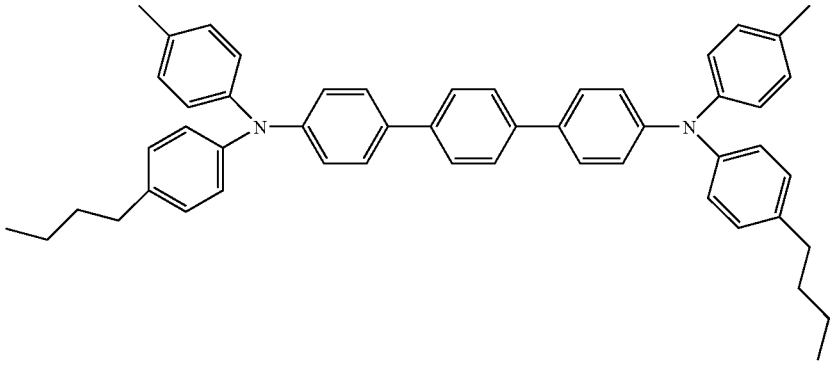

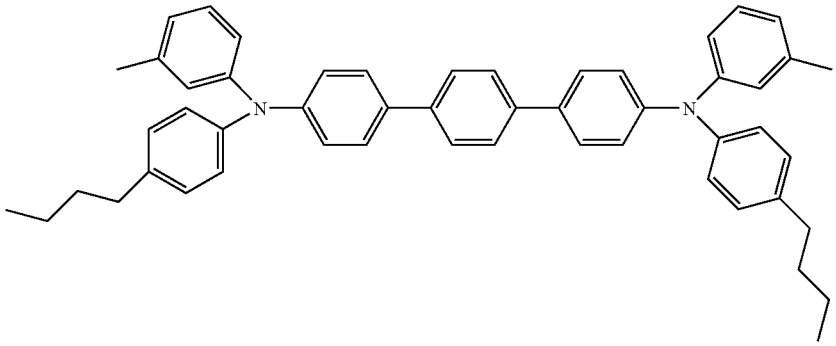

and

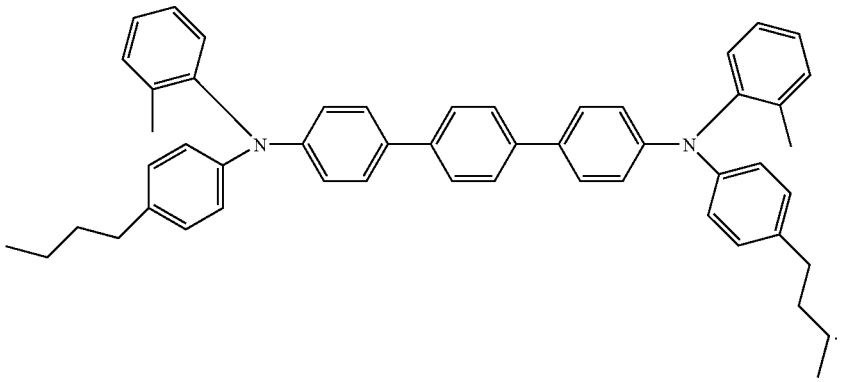

Examples of the binder materials selected for the charge transport layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000. Generally, the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, "charge transport" refers, for example, to charge transporting molecules as a monomer that allows the free charge generated in the photogenerating layer to be transported across the transport layer.

Examples of the charge transport hole transporting molecules present, for example, in an amount of from about 50 to about 75 weight percent, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terpheny]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine; hydrazones such as N-phenyl-N-methyl-3-(9-ethyl) carbazyl hydrazone, and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments, to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency, and transports them across the charge transport layer with short transit times includes N,N'-diphenyl-N,N'-bis(3-methylphenyl)-(1,1'-biphenyl)-4,4'-diamine, N,N'-bis (4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine, or mixtures thereof. If desired, the charge transport material in the charge transport layer may comprise a polymeric charge transport material, or a combination of a small molecule charge transport material and a polymeric charge transport material.

Examples of components or materials optionally incorporated into the charge transport layers or at least one charge transport layer to, for example, enable excellent lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

A number of processes may be used to mix and thereafter apply the charge transport layer or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each charge transport layer in embodiments is from about 10 to about 70 microns, but thicknesses outside this range may, in embodiments, also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported to selectively discharge a surface charge on the surface of the active layer. Typical application techniques include spraying, dip coating, roll coating, wire wound rod coating, and the like. Drying of the deposited coating may be effected by any suitable conventional technique, such as oven drying, infrared radiation drying, air drying, and the like. An optional top overcoating layer, such as the overcoating of copending U.S. application Ser. No. 11/593,875, Publication No. 20080107985, the disclosure of which is totally incorporated herein by reference, may be applied over the charge transport layer to provide abrasion protection.

Aspects of the present disclosure relate to a photoconductive imaging member comprised of a first ACBC layer, a supporting substrate, a photogenerating layer, a charge transport layer, and an overcoating charge transport layer; a photoconductive member with a photogenerating layer of a thickness of from about 0.1 to about 10 microns, and at least one transport layer, each of a thickness of from about 5 to about 100 microns; an imaging method and an imaging apparatus containing a charging component, a development component, a transfer component, and a fixing component, and wherein the apparatus contains a photoconductive imaging member comprised of a first layer, a supporting substrate, and thereover a layer comprised of a photogenerating pigment and a charge transport layer or layers, and thereover an overcoat charge transport layer, and where the transport layer is of a thickness of from about 20 to about 75 microns; a member wherein the photogenerating layer contains a photogenerating pigment present in an amount of from about 5 to about 95 weight percent; a member wherein the thickness of the photogenerating layer is from about 0.1 to about 4 microns; a member wherein the photogenerating layer contains photogenerating pigment and a polymer binder; a member wherein the photogenerating binder is present in an amount of from about 50 to about 90 percent by weight, and wherein the total of all layer components is about 100 percent; a member wherein the photogenerating component is a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating pigment is a metal free phthalocyanine; an imaging member wherein each of the charge transport layers, such as 1, 2, or 3 layers, and especially 2 layers, comprises

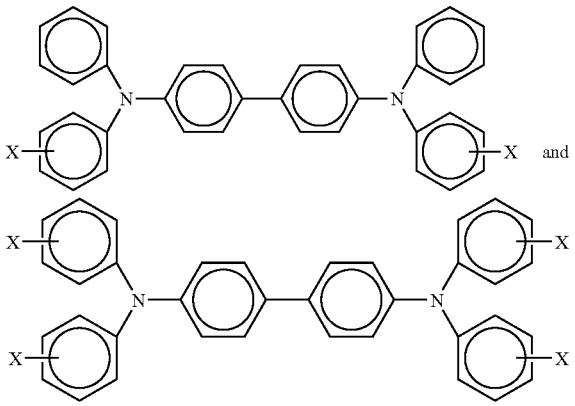

wherein X is selected from the group consisting of alkyl, alkoxy, aryl, and halogen, and more specifically, methyl and halo; an imaging member wherein alkyl and alkoxy contains from about 1 to about 12 carbon atoms; an imaging member wherein alkyl contains from about 1 to about 7 carbon atoms; an imaging member wherein alkyl is methyl; an imaging member wherein each of, or at least one of the charge transport layers comprises

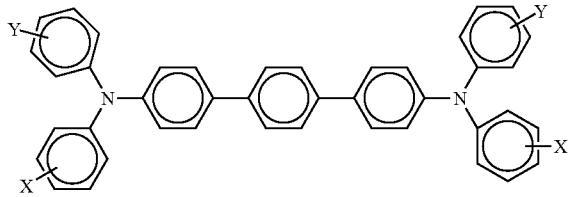

wherein X and Y are independently alkyl, alkoxy, aryl, a halogen, or mixtures thereof; an imaging member wherein alkyl and alkoxy contains from about 1 to about 12 carbon atoms; an imaging member wherein alkyl contains from about 1 to about 5 carbon atoms, and wherein the resinous binder is selected from the group consisting of polycarbonates and polystyrene; an imaging member wherein the photogenerating pigment present in the photogenerating layer is comprised of chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; a method of imaging which comprises generating an electrostatic latent image on an imaging member developing the latent image, and transferring the developed electrostatic image to a suitable substrate; a method of imaging wherein the imaging member is exposed to light of a wavelength of from about 370 to about 950 nanometers; a photoconductive member wherein the photogenerating layer is situated between the substrate and the charge transport layer; a member wherein the charge transport layer is situated between the substrate and the photogenerating layer; a member wherein the photogenerating layer is of a thickness of from about 0.1 to about 50 microns; a member wherein the photogenerating component pigment amount is from about 0.5 weight percent to about 20 weight percent, and wherein the photogenerating pigment is optionally dispersed in from about 1 weight percent to about 80 weight percent of a polymer binder; a member wherein the binder is present in an amount of from about 50 to about 90 percent by weight, and wherein the total of the layer components is about 100 percent; an imaging member wherein the photogenerating component is Type V hydroxygallium phthalocyanine, or chlorogallium phthalocyanine, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine molecules, and wherein the hole transport resinous binder is selected from the group consisting of polycarbonates and polystyrene; an imaging member wherein the photogenerating layer contains a metal free phthalocyanine; an imaging member wherein the photogenerating layer contains an alkoxygallium phthalocyanine; a photoconductive imaging member with a blocking layer contained as a coating on a substrate, and an adhesive layer coated on the blocking layer; a color method of imaging which comprises generating an electrostatic latent image on the imaging member, developing the latent image, transferring, and fixing the developed electrostatic image to a suitable substrate; photoconductive imaging members comprised of a supporting substrate, a photogenerating layer, a hole transport layer and a top overcoating layer in contact with the hole transport layer or in embodiments in contact with the photogenerating layer, and in embodiments wherein a plurality of charge transport layers are selected, such as for example, from two to about ten, and more specifically, two may be selected; and a photoconductive imaging member comprised of an optional supporting substrate, a photogenerating layer, and a first, second, and third charge transport layer. In embodiments, at least one charge transport layer refers, for example, to 1, 2, 3, 4, 5, 6, or 7 layers, and especially 1 or 2 layers, and yet more specifically, 2 layers.

The following Examples are being submitted to illustrate embodiments of the present disclosure.

COMPARATIVE EXAMPLE 1

A belt photoconductor was prepared as follows.

There was coated a 0.02 micron thick titanium layer on the biaxially oriented polyethylene naphthalate substrate (KALEDEX™ 2000) having a thickness of 3.5 mils, and applying thereon, with a gravure applicator or an extrusion coater, a hole blocking layer solution containing 50 grams of 3-aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in a forced air dryer. The resulting hole blocking layer had a dry thickness of 500 Angstroms. An adhesive layer was then prepared by applying a wet coating over the blocking layer using a gravure applicator or an extrusion coater, and which adhesive contained 0.2 percent by weight based on the total weight of the solution of the copolyester adhesive (ARDEL™ D100 available from Toyota Hsutsu Inc.) in a 60:30:10 volume ratio mixture of tetrahydrofuran/monochlorobenzene/methylene chloride. The adhesive layer was then dried for about 1 minute at 120° C. in the forced air dryer. The resulting adhesive layer had a dry thickness of 200 Angstroms.

A photogenerating layer dispersion was prepared by introducing 0.45 gram of the known polycarbonate IUPILON™ 200 (PCZ-200) or POLYCARBONATE Z™, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. This slurry was then placed on a shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer having a thickness of 0.4 micron.

The photoconductor imaging member web was then coated over with two charge transport layers. Specifically, the photogenerating layer was overcoated with a charge transport layer (the bottom layer) in contact with the photogenerating layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine, and poly(4,4'-isopropylidene diphenyl) carbonate, a known bisphenol A polycarbonate having a $M_w$ molecular weight average of about 120,000, commercially available from Farbenfabriken Bayer A.G. as MAKROLON® 5705. The resulting mixture was then dissolved in methylene chloride to form a solution containing 15 percent by weight solids. This solution was applied on the photogenerating layer to form the bottom layer coating that upon drying (120° C. for 1 minute) had a thickness of 14.5 microns. During this coating process, the humidity was equal to or less than 15 percent.

The bottom layer of the charge transport layer was then overcoated with a top layer. The charge transport layer solution of the top layer was prepared as described above for the bottom layer. This solution was applied on the bottom layer of the charge transport layer to form a coating that upon drying (120° C. for 1 minute) had a thickness of 14.5 microns. During this coating process, the humidity was equal to or less than 15 percent.

An anticurl backside coating layer (ACBC) coating solution was prepared by introducing into an amber glass bottle in a weight ratio of 8:92 VITEL® 2200, a copolyester of iso/terephthalic acid, dimethylpropanediol, and ethanediol having a melting point of from about 302° C. to about 320° C. (degrees Centigrade), commercially available from Shell Oil Company, Houston, Tex., and MAKROLON® 5705, a known polycarbonate resin having a $M_w$ molecular weight average of from about 50,000 to about 100,000, commercially available from Farbenfabriken Bayer A.G. The resulting mixture was then dissolved in methylene chloride to form a solution containing 9 percent by weight solids. This solution was applied on the back of the above KALEDEX™ 2000 substrate of the belt photoconductor to form a coating of the anticurl backside coating layer of VITEL® 2200/MAKROLON® 5705 at a ratio of 8/92 that upon drying (120° C. for 1 minute) had a thickness of 17.4 microns. During this coating process, the humidity was about 15 percent.

EXAMPLE I

A photoconductor was prepared by repeating the process of Comparative Example 1 except that the ACBC layer coating dispersion was prepared by (1) adding to the above Comparative Example 1 ACBC layer coating solution 5 percent by weight of the nano diamond NB90, obtained from NANOBLOX Inc.; (2) milling the mixture obtained with 2 millimeter stainless shot at 160 rpm overnight, about 23 hours; and (3) separating the stainless shot from the nano diamond dispersion via filtration. This nano diamond dispersion obtained was then applied on the back or reverse side opposite the surface of the photoconductor substrate to form a coating of the anticurl backside coating layer of VITEL® 2200/MAKROLON® 5705/NB90 at a ratio of 7.6/87.6/4.8, and that upon drying (120° C. for 1 minute) had a thickness of 18.3 microns. During this coating process, the humidity was about 15 percent.

EXAMPLE II

A photoconductor was prepared by repeating the process of Comparative Example 1 except that the ACBC layer coating dispersion was prepared by (1) adding to the above Comparative Example 1 ACBC layer coating solution 10 percent by weight of the nano diamond NB90, obtained from NANOBLOX Inc.; (2) milling the mixture obtained with 2 millimeter stainless shot at 160 rpm overnight, about 23 hours; and (3)

separating the stainless shot from the nano diamond dispersion via filtration. This nano diamond dispersion was then applied on the back of the photoconductor substrate to form a coating of the anticurl backside coating layer of VITEL® 2200/MAKROLON® 5705/NB90 at a ratio of 7.3/83.6/9.1, and that upon drying (120° C. for 1 minute) had a thickness of 19.1 microns. During this coating process, the humidity was about 15 percent.

Surface Resistivity Measurement

The ACBC layers of the photoconductors of Comparative Example 1, and Examples I and II were measured for surface resistivity (under 500V, averaging four to six measurements at varying spots, 72° F./65 percent room humidity) using a High Resistivity Meter (Hiresta-Up MCP-HT450 from Mitsubishi Chemical Corp.), and the results are provided in Table 1.

TABLE 1

| ACBC Layer | Surface Resistivity (ohm/sq) | Friction Coefficient |
|---|---|---|
| Comparative Example 1 | $>10^{16}$ | 0.45 |
| Example I | $2.08 \times 10^{13}$ | 0.41 |
| Example II | $2.65 \times 10^{11}$ | 0.40 |

With the incorporation of the conductive nano diamond, the disclosed ACBC layers were more conductive than the controlled Comparative Example ACBC layer. With 5 weight percent of the nano diamond, the resistivity of the ACBC layer was 3 orders of magnitude lower; with 10 weight percent of the nano diamond, the resistivity was 5 orders of magnitude lower. It is believed that the nano diamond conductive ACBC layer will help eliminate charge buildup at the back of the photoconductor.

Friction Coefficient Measurements

The coefficients of kinetic friction of the ACBC layers of Comparative Example 1, and Examples I and II photoconductors against a polished stainless steel surface were measured by the known COF Tester (Model D5095D, Dynisco Polymer Test, Morgantown, Pa.) according to ASTM D1894-63, procedure A. The tester was facilitated with a 2.5"×2.5", 200 gram weight with rubber on one side, a moving polished stainless steel sled, and a DFGS force gauge (250 grams maximum). The photoconductors were cut into 2.5"×3.5" pieces and taped onto the 200 gram weight on the rubber side with the surfaces to be tested facing the sled. The coefficient of kinetic friction was the ratio of the kinetic friction force (F) between the surfaces in contact to the normal force: F/N, where F was measured by the gauge and N is the weight (200 grams). The measurements were conducted at a sled speed of 6 inches/minute and at ambient conditions. Three measurements were performed for each photoconductor tested, and their coefficient of friction (slipperies) averages are also reported in Table 1.

With the incorporation of the nano diamond, the disclosed ACBC layers were about 10 percent more slippery than the controlled ACBC layer. It is believed that a slippery ACBC layer will also help eliminate charge buildup at the back of the photoconductor.

While the wear or scratch resistance of the disclosed ACBC layer was not specifically measured, it is believed that the disclosed photoconductor with the ACBC layer containing the conductive nano diamond is more wear or scratch resistant than the Comparative Example 1 ACBC layer due to (1) its hard diamond component; (2) its slippery surface; and (3) its high conductivity.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor consisting essentially of a first anticurl layer, a supporting substrate thereover, a photogenerating layer, and at least one charge transport layer comprised of at least one charge transport component, and wherein said first anticurl layer is in contact with said supporting substrate on the reverse side thereof, and which first anticurl layer consists essentially of a nano diamond component dispersed in a polymer wherein said nano diamond component has a diameter of from about 30 to about 100 nanometers, said nano diamond component is comprised of a diamond core and a graphite shell thereover.

2. A photoconductor in accordance with claim 1 wherein said nano diamond component is comprised of a diamond core and a graphite shell thereover, and wherein said diamond core is present in an amount of from about 20 to about 99.9 weight percent, and said shell includes functional groups thereon, and wherein said at least one charge transport layer is 1, 2, or 3 layers.

3. A photoconductor in accordance with claim 2 wherein said diamond core is present in an amount of from about 50 to about 98 weight percent, and said functional groups are comprised of at least one of carbon, oxygen, nitrogen and a metal.

4. A photoconductor in accordance with claim 2 wherein said functional groups are comprised of at least one of —OH, —COOH, —$NH_2$, a quaternerized amine, —$CH_3$, Cu, Fe, Ag, Au, and Al.

5. A photoconductor in accordance with claim 1 wherein said nano diamond component is of a spherical shape, and said at least one charge transport layer is 1 or 2 layers.

6. A photoconductor in accordance with claim 1 wherein said nano diamond component is present in an amount of from about 1 to about 30 weight percent.

7. A photoconductor in accordance with claim 1 wherein said nano diamond component is present in an amount of from about 5 to about 10 weight percent.

8. A photoconductor in accordance with claim 1 wherein said polymer is at least one of a polyarylate, an acrylic, a vinyl polymer, a cellulose polymer, a polyester, a polyimide, a polyurethane, a poly(cyclo olefin), an epoxy resin, and copolymers thereof.

9. A photoconductor in accordance with claim 1 wherein said polymer is a polycarbonate, and wherein said at least one layer is 1, 2, or 3 layers.

10. A photoconductor in accordance with claim 1 wherein said first anticurl layer is located opposite the supporting substrate surface not in contact with the photogenerating layer.

11. A photoconductor in accordance with claim 1 wherein said charge transport component is comprised of at least one of a

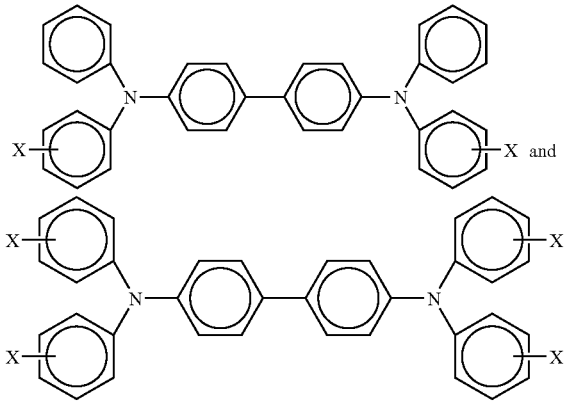

wherein X is selected from the group consisting of at least one of alkyl, alkoxy, aryl, and halogen.

12. A photoconductor in accordance with claim 11 wherein said alkyl and said alkoxy each contains from about 1 to about 12 carbon atoms, and said aryl contains from about 6 to about 36 carbon atoms, and wherein said at least one charge transport layer is 4 or less layers.

13. A photoconductor in accordance with claim 11 wherein said charge transport component is an aryl amine of N,N'-diphenyl-N,N-bis(3-methylphenyl)-1,1'-biphenyl-4,4'-diamine.

14. A photoconductor in accordance with claim 1 wherein said charge transport component is comprised of

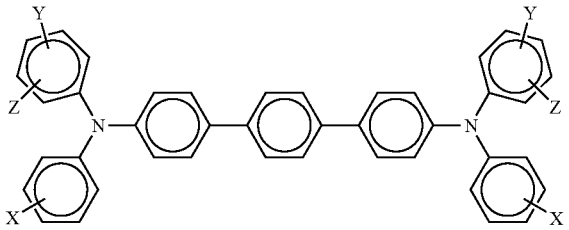

wherein X, Y and Z are independently selected from the group consisting of at least one of alkyl, alkoxy, aryl, and halogen; and said nano diamond component is comprised of a diamond core and a graphite shell.

15. A photoconductor in accordance with claim 14 wherein said alkyl and alkoxy each contains from about 1 to about 12 carbon atoms, and said aryl contains from about 6 to about 36 carbon atoms.

16. A photoconductor in accordance with claim 1 wherein said charge transport component is selected from the group consisting of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and mixtures thereof; and said at least one charge transport layer is 2, or 3 layers.

17. A photoconductor in accordance with claim 1 wherein said first anticurl layer has a thickness of from about 5 to about 70 microns.

18. A photoconductor in accordance with claim 1 wherein said photoconductor further includes in at least one of said charge transport layers an antioxidant comprised of at least one of a hindered phenolic and a hindered amine.

19. A photoconductor in accordance with claim 1 wherein said photogenerating layer is comprised of a photogenerating pigment or photogenerating pigments.

20. A photoconductor in accordance with claim 19 wherein said photogenerating pigment is comprised of at least one of a metal phthalocyanine, a metal free phthalocyanine, a perylene, and mixtures thereof.

21. A photoconductor in accordance with claim 1 further including a hole blocking layer, and an adhesive layer, wherein said substrate is comprised of a conductive material, and wherein said hole blocking layer is in contact with said substrate, and said adhesive layer is in contact with said hole blocking layer.

22. A photoconductor in accordance with claim 1 wherein said at least one charge transport layer is from 1 to about 4 layers, and wherein said charge transport component is represented by at least one of

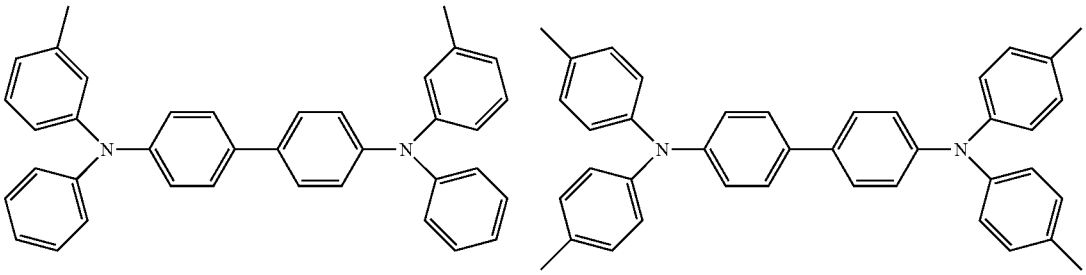

-continued

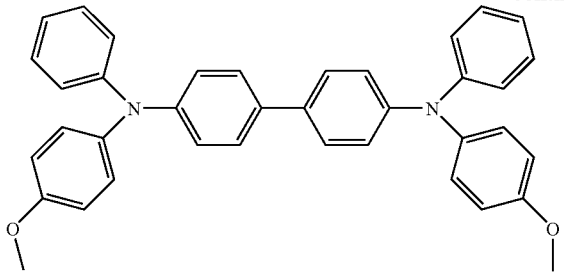

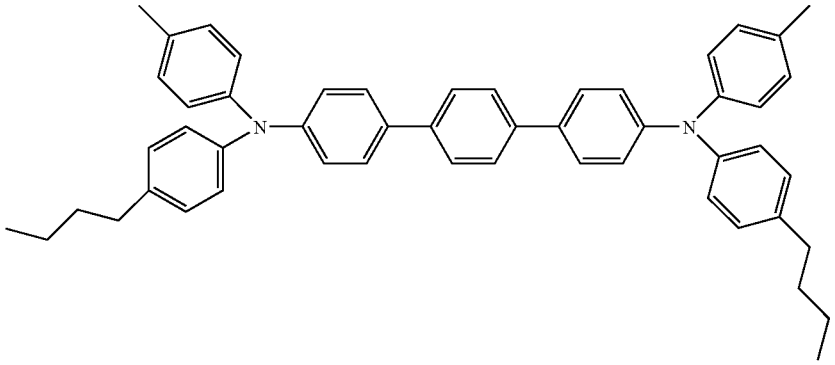

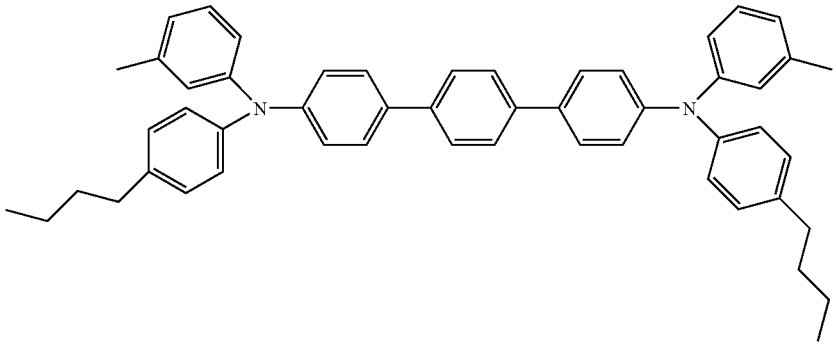

and

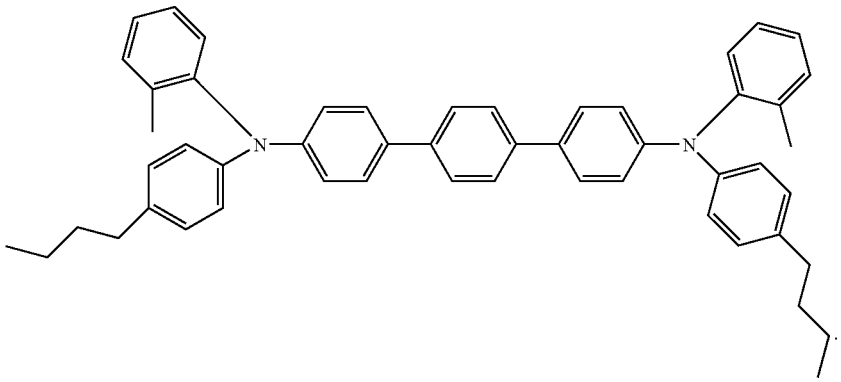

23. A photoconductor in accordance with claim 1 wherein said at least one charge transport layer is comprised of a top charge transport layer and a bottom charge transport layer, and wherein said top charge transport layer is in contact with said bottom charge transport layer, and said bottom charge transport layer is in contact with said photogenerating layer.

24. A photoconductor consisting essentially of and in sequence of a supporting substrate, a photogenerating layer thereover, and a charge transport layer, and wherein said substrate includes on the reverse side thereof an anticurl layer consisting of a nano diamond with a diameter of from about 30 to about 100 nanometers, and which nano diamond is present in an amount of from about 1 to about 15 weight percent, wherein said nano diamond consists essentially of a diamond core and a graphite shell; and wherein said nano diamond is dispersed in at least one of a polyarylate, an acrylic, a vinyl polymer, a cellulose polymer, a polyester, a polyamide, a polyurethane,a poly(cycloolefin), a polycarbonate, and an epoxy.

25. A photoconductor in accordance with claim 24 wherein said anticurl layer has a thickness of from about 10 to about 50 microns.

26. A photoconductor in accordance with claim 24 wherein said nano diamond possesses about 50 percent of $sp^3$ carbon and 50 percent of $sp^2$ carbon, about 90 percent of $sp^3$ carbon and about 10 percent of $sp^2$ carbon, or about 98 percent of $sp^3$ carbon and about 2 percent of $sp^2$ carbon; and wherein said nano diamond is modified to further include therein at least one of —OH, —COOH, —$NH_2$, —$CH_3$, Cu, Fe, Ag, Au, and Al.

27. A photoconductor consisting of and in sequence, a nano diamond anticurl backside coating, which nano diamond is comprised of a diamond core and a graphite shell, a supporting substrate, a photogenerating layer thereover, and a hole transport layer, wherein said nano diamond is dispersed in a polymer and said nano diamond has a diameter of from about 30 to about 100 nanometers and wherein said hole transport layer is comprised of a top hole transport layer and a bottom hole transport layer, and wherein said top hole transport is in contact with said bottom hole transport layer, and said bottom hole transport layer is in contact with said photogenerating layer.

* * * * *